US008511680B2

(12) United States Patent
Souda

(10) Patent No.: US 8,511,680 B2
(45) Date of Patent: Aug. 20, 2013

(54) IMAGE FORMING DEVICE CAPABLE OF RELIABLY TRANSMITTING DRIVING FORCE TO BELT UNIT

(75) Inventor: Makoto Souda, Nagoya (JP)

(73) Assignee: Brother Kogyo Kabushiki Kaisha, Nagoya-shi (JP)

( * ) Notice: Subject to any disclaimer, the term of this patent is extended or adjusted under 35 U.S.C. 154(b) by 767 days.

(21) Appl. No.: 12/699,946

(22) Filed: Feb. 4, 2010

(65) Prior Publication Data

US 2010/0215419 A1 Aug. 26, 2010

(30) Foreign Application Priority Data

Feb. 25, 2009 (JP) ..... 2009-041887

(51) Int. Cl.
*G03G 15/00* (2006.01)

(52) U.S. Cl.
USPC ..... 271/275; 399/107

(58) Field of Classification Search
USPC ..... 271/275; 399/107
See application file for complete search history.

(56) References Cited

U.S. PATENT DOCUMENTS

| | | | | |
|---|---|---|---|---|
| 7,623,809 | B2 | 11/2009 | Nakano et al. | |
| 7,835,663 | B2 | 11/2010 | Tomatsu et al. | |
| 7,894,743 | B2 | 2/2011 | Tomatsu | |
| 8,175,491 | B2 * | 5/2012 | Tomatsu et al. | 399/107 |
| 2007/0160382 | A1 | 7/2007 | Tomatsu | |
| 2007/0177894 | A1 | 8/2007 | Nakano et al. | |
| 2008/0002341 | A1 | 1/2008 | Tomatsu | |
| 2008/0003015 | A1 | 1/2008 | Tomatsu et al. | |
| 2010/0014887 | A1 * | 1/2010 | Tomatsu et al. | 399/107 |
| 2010/0019443 | A1 * | 1/2010 | Ichikawa | 271/241 |
| 2011/0064455 | A1 * | 3/2011 | Ohba et al. | 399/107 |

FOREIGN PATENT DOCUMENTS

| | | | |
|---|---|---|---|
| JP | 01-169466 | A | 7/1989 |
| JP | 10-123786 | A | 5/1998 |
| JP | 11-202586 | A | 7/1999 |
| JP | 2007-010839 | A | 1/2007 |
| JP | 2007-148142 | | 6/2007 |
| JP | 2008-009260 | A | 1/2008 |
| JP | 2008-009262 | A | 1/2008 |

OTHER PUBLICATIONS

JP Office Action dtd Feb. 15, 2011, JP Appln. 2009-041887, English Translation.

* cited by examiner

*Primary Examiner* — Jeremy R Severson
(74) *Attorney, Agent, or Firm* — Banner & Witcoff, Ltd.

(57) ABSTRACT

An image forming device includes a main body having a metal main frame, first and second resin frames attached to the main frame, a conveying section attached to the first resin frame and made of third resin, an input section provided to the conveying section, and an output section supported to the second resin frame and liked to the input section. The conveying section conveys a recording medium upon receiving driving force through the input section and the output section. Both the first and second resin frames have a higher liner expansion coefficient than the main frame, and a linear expansion coefficient of the third resin is higher than that of the main frame and lower than that of the first and second resin frames.

20 Claims, 5 Drawing Sheets

IMAGE FORMING DEVICE CAPABLE OF RELIABLY TRANSMITTING DRIVING FORCE TO BELT UNIT

CROSS REFERENCE TO RELATED APPLICATION

This application claims priority from Japanese Patent Application No. 2009-041887 filed Feb. 25, 2009. The entire content of this priority application is incorporated herein by reference.

TECHNICAL FIELD

The present invention relates to an image forming device, such as a laser printer.

BACKGROUND

There has been known a laser printer capable of forming a color image. Such a laser printer includes a main frame having a pair of side walls spaced apart in a horizontal direction, and each of the side walls includes a resin frame and a metal frame.

The laser printer also includes a plurality of image forming units disposed between the side walls and a belt unit disposed beneath the image forming units. Each image forming unit includes a photosensitive drum for bearing a toner image. The belt unit is mainly made of resin and supported to the resin frames of the side walls. The belt unit includes a belt frame, a pair of belt support rollers supported to the belt frame, and an endless conveying belt wrapped around the pair of belt support rollers.

A drive motor is disposed on the resin frame, and a gear is attached to an output shaft of the drive motor. Another gear is attached to one of the belt support rollers and is in meshing engagement with the gear attached to the output shaft of the drive motor.

With this configuration, during image forming operations, driving force generated by the drive motor is transmitted to the belt support roller to rotate the same. Rotation of the belt support roller rotates the conveying belt to covey a sheet of recording paper, and the toner image formed on each photosensitive drum is transferred onto the recording paper on the conveying belt.

SUMMARY

It is an object of the invention to provide an image forming device capable of reliably transmitting driving force to a belt unit.

In order to attain the above and other objects, the invention provides an image forming device including a main body, a plurality of photosensitive members, a first frame, a second frame, a conveying section, an input section, and an output section. The main body includes a main frame made of metal. The plurality of photosensitive members are arrayed in the main body. The first frame is attached to the main frame and made of first resin with a higher liner expansion coefficient than the main frame. The second frame is attached to the main frame and made of second resin with a higher linear expansion coefficient than the main frame. The conveying section is attached to the first frame so as to confront the plurality of photosensitive members. The conveying section is made of third resin with a linear expansion coefficient that is higher than that of the main frame and lower than that of the first frame and the second frame. The input section is provided to the conveying section for transmitting a driving force to the conveying section. The conveying section conveys a recording medium upon receiving the driving force through the input section. The output section is supported to the second frame and linked to the input section. The output section transmits the driving force to the input section.

BRIEF DESCRIPTION OF THE DRAWINGS

The particular features and advantages of the invention as well as other objects will become apparent from the following description taken in connection with the accompanying drawings, in which.

DETAILED DESCRIPTION

An image forming device according to an embodiment of the invention will be described while referring to the accompanying drawings.

The terms "upward", "downward", "upper", "lower", "above", "below", "beneath", "right", "left", "front", "rear" and the like will be used throughout the description assuming that the image forming device is disposed in an orientation in which it is intended to be used. The present embodiment pertains to a printer 1 shown FIG. 1.

Figure 1:
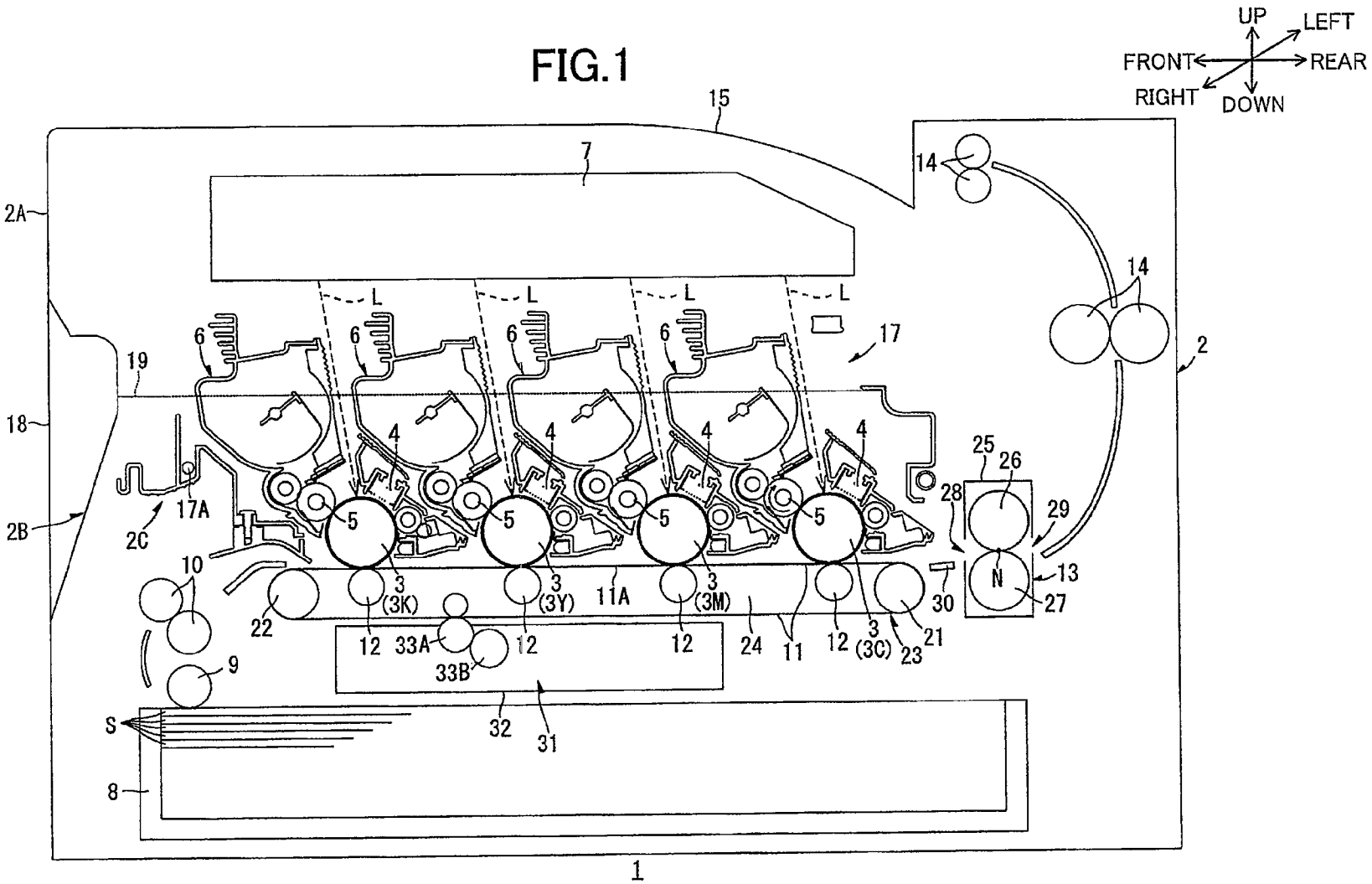
FIG. 1 is an illustrative cross-sectional right-side view of a printer according to an embodiment of the present invention.

The printer 1 is a direct tandem type color printer and, as shown in FIG. 1, includes a main casing 2 in a substantial box shape elongated in a front-to-rear direction (predetermined direction) and a process unit 17 detachably accommodated in the main casing 2.

The process unit 17 includes four photosensitive drums 3, four developer cartridges 6, and four Scorotron chargers 4. The photosensitive drums 3 are arranged parallel to each other so as to be rotatable about their axes extending in the width direction (left-to-right direction), and are juxtaposed in the front-to-rear direction. Each developer cartridge 6 supports a developing roller 5. Each developing roller 5 and each Scorotron charger 4 are positioned adjacent to and confront the corresponding photosensitive drum 3.

During image forming operations, each of the chargers 4 uniformly charges the peripheral surface of the corresponding photosensitive drum 3. Then, the outer peripheral surface of each photosensitive drum 3 is exposed by a laser beam L emitted from a scanner unit 7 disposed in the upper section of the main casing 2. As a result, an electrostatic latent image corresponding to image data is formed on the outer peripheral surface of each photosensitive drum 3. Subsequently, the toner carried on the developing roller 5 is selectively supplied to the electrostatic latent image on the photosensitive drum 3. As a result, the electrostatic latent image is transformed into a visible toner image. In this manner, the toner image is formed on the photosensitive drum 3.

Each of the developer cartridges 6 accommodates toner of a different color. In this embodiment, the colors of toner accommodated in the developer cartridges 6 are black, yellow, magenta, and cyan. Accordingly, the color of the toner images formed on each photosensitive drum 3 also differs according to the photosensitive drum 3. In the following description, the four photosensitive drums 3 will be differentiated based on the color of the toner image formed thereon. Specifically, the photosensitive drums 3 include a black photosensitive drum 3K, a yellow photosensitive drum 3Y, a magenta photosensitive drum 3M, and a cyan photosensitive drum 3C, arranged in this order from front to rear.

The main casing 2 has a front wall 2A formed with an opening 2B. The main casing 2 also has a cover 18 for selectively opening and closing the opening 2B. The process unit 17 can be detached from or mounted on the main casing 2 through the opening 2B when the cover 18 is open.

The printer 1 also includes, within the main casing 2, a sheet-supply cassette 8, a sheet-supply roller 9, a pair of registration rollers 10, a belt unit 23, and a fixing unit 13. The belt unit 23 includes a conveying belt 11, a drive roller 21, a follow roller 22, four transfer rollers 12, and a belt frame 24.

The sheet supply cassette 8 accommodates stacked sheets S of paper. During image-forming operations, the sheet supply roller 9 disposed above the front edge of the sheet supply cassette 8 feeds the topmost sheet S accommodated in the sheet supply cassette 8 forward. The path along which the sheet S is fed is such that the sheet S is conveyed upward while being reversed from a forward direction to a rearward direction.

When fed upward, the leading edge of the sheet S is interposed between the pair of registration rollers 10. At a prescribed timing, the registration rollers 10 continue to convey the sheet S rearward onto the conveying belt 11.

The conveying belt 11 is an endless belt formed of a resin material and is wider than the sheet S. The conveying belt 11 is mounted over the drive roller 21 and the follow roller 22 and pulled taut with a prescribed force. The drive roller 21 and the follow roller 22 are arranged parallel to each other and are separated in the front-to-rear direction.

Center axes of the drive roller 21 and the follow roller 22 extend in the width direction. The drive roller 21 is disposed on the rear side of the photosensitive drum 3C, and the follow roller 22 is disposed on the front side of the photosensitive drum 3K.

When viewed along the width direction, the conveying belt 11 has a circular shape, elongated in the front-to-rear direction and flattened on the top and bottom. The portion of the conveying belt 11 running between the top of the drive roller 21 and the top of the follow roller 22 will be referred to as an upper portion 11A of the conveying belt 11. The top surface of the upper portion 11A is substantially horizontal. The four photosensitive drums 3 described above contact the top surface of the upper portion 11A of the conveying belt 11.

The four transfer rollers 12 are positioned inside the conveying belt 11, i.e., in the area between the drive roller 21 and the follow roller 22. The transfer rollers 12 are arranged parallel to each other and juxtaposed in the front-to-rear direction. Each transfer roller 12 confronts the bottom surface of the corresponding photosensitive drum 3, with the upper portion 11A of the conveying belt 11 interposed therebetween. Each of the transfer rollers 12 is applied with a transfer bias.

The belt frame 24 rotatably supports the drive roller 21, the follow roller 22, and the transfer rollers 12. The belt unit 23 can be mounted on and removed from the main casing 2 through the opening 2B by opening the cover 18 to expose the opening 2B. When mounted on the main casing 2, the belt unit 23 confronts the photosensitive drums 3.

As described above, the registration rollers 10 convey a sheet S to the conveying belt 11 and transfer the sheet S onto the surface of the upper portion 11A. The drive roller 21 is driven to rotate when driving force is applied to the drive roller 21 via an input gear 50 (FIG. 2), and the rotation of the drive roller 21 drives the conveying belt 11 to circulate clockwise in FIG. 1. Accordingly, a sheet S transferred onto the upper portion 11A is conveyed rearward.

At this time, toner images carried on the surfaces of the photosensitive drums 3 are transferred onto the top surface of the sheet S being conveyed on the top surface of the upper portion 11A by the transfer bias applied to the corresponding transfer rollers 12. The sequentially transferred images are superimposed over each other. Since the toner images carried on the photosensitive drums 3 are each of a different color, as described above, the toner images of the four colors form a color image when superimposed on the sheet S.

As the four toner images (color image) are transferred onto the sheet S from the four photosensitive drums 3, the conveying belt 11 continues to convey the sheet S rearward toward the fixing unit 13 disposed on the rear side of the belt unit 23.

Figure 2:
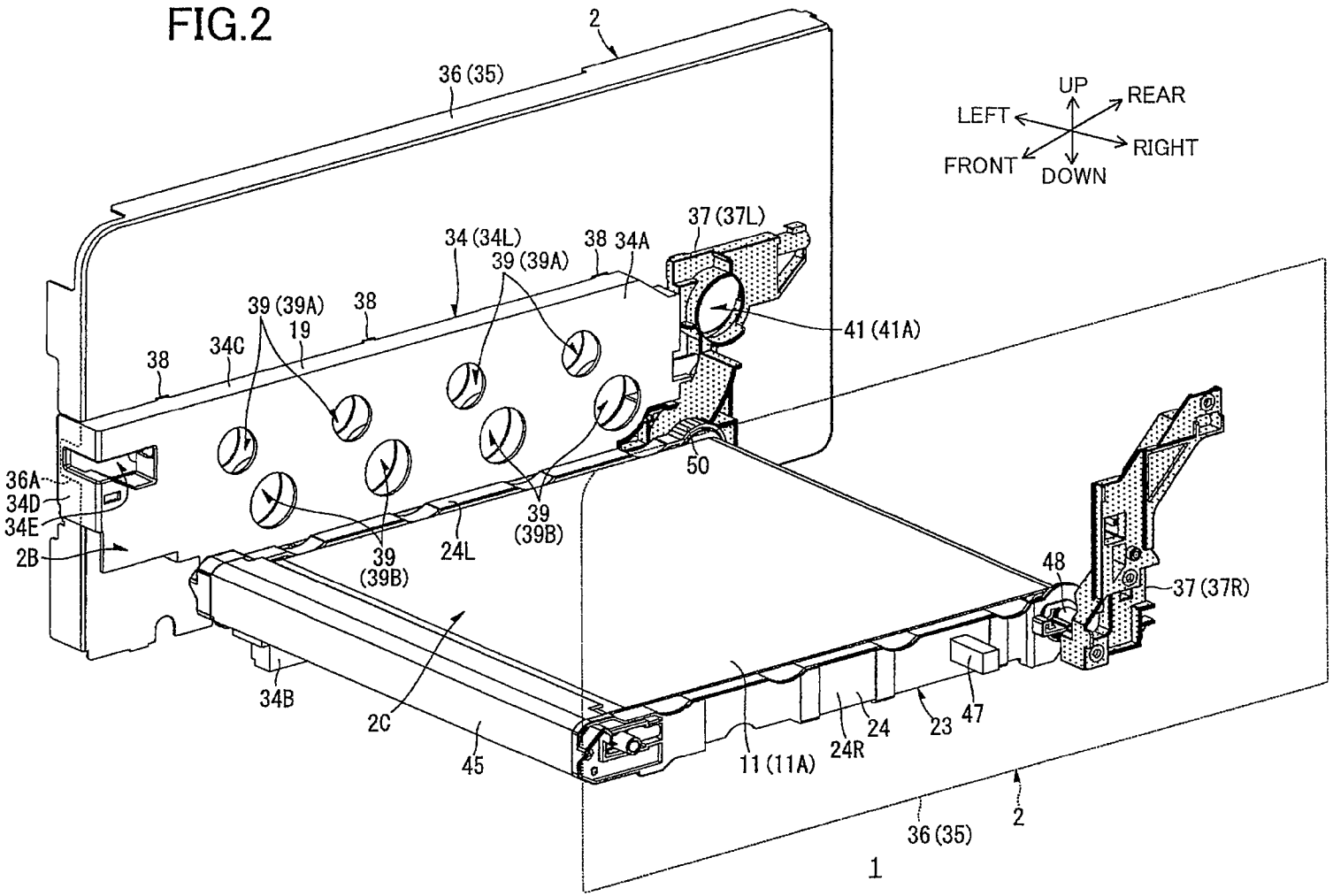
FIG. 2 is a perspective view of relevant parts of the printer within a main casing from a point diagonally rightward and frontward thereof.

That is, the belt unit 23 conveys the sheet S with the four toner images (color image) transferred from the photosensitive drums 3 when driving force is applied to the drive roller 21 via the input gear 50 (FIG. 2).

The fixing unit 13 includes a fixing casing 25, a heat roller 26, and a pressure roller 27. The fixing casing 25 is in a hollow box shape elongated in the width direction. The fixing casing 25 has a front surface formed with an inlet 28 and a rear surface formed with an outlet 29. Both the inlet 28 and the outlet 29 are in fluid communication with the interior of the fixing casing 25, and are elongated in the width direction to have an enough width to let the sheet S pass therethrough.

The heat roller 26 and the pressure roller 27 are disposed in the fixing casing 25 so as to be rotatable about respective center axes extending in the width direction. The peripheral surface of the heat roller 26 is covered with a fluorine resin, for example. The heat roller 26 also has a built-in halogen lamp (not shown) for heating the peripheral surface of the heat roller 26.

The peripheral surface of the pressure roller 27 is covered with a silicon rubber, for example. The pressure roller 27 presses against the bottom of the heat roller 26. The area of contact between the heat roller 26 and the pressure roller 27, referred to as a "nip position N" herein, is positioned rearward of the inlet 28 and forward of the outlet 29.

The sheet S conveyed to the fixing unit 13 enters the fixing casing 25 through the inlet 28 and passes rearward through the nip position N between the heat roller 26 and the pressure roller 27.

When the sheet S passes through the nip position N, the pressure roller 27 presses the upper surface of the sheet S transferred with the toner image against the heated outer peripheral surface of the heat roller 26. As a result, the toner image is thermally fixed onto the upper surface of the sheet S.

Then, the sheet S is discharged out of the fixing casing 25 through the outlet 29. Subsequently, the sheet S is conveyed by pairs of conveying rollers 14 disposed downstream of the fixing unit 13 along a sheet-conveying path. The conveying rollers 14 convey the sheet S along a path that guides the sheet S upward while changing from a rearward direction to a forward direction, and discharge the sheet S onto a discharge tray 15 provided on top of the main casing 2.

The printer 1 further includes a guide member 30 disposed within the main casing 2 at a position between the belt unit 23 and the fixing unit 13. From the upper portion 11A of the conveying belt 11, a sheet S conveyed rearward passes over the top surface of the guide member 30 and enters the inlet 28 of the fixing unit 13. Hence, the guide member 30 receives the sheet S conveyed by the belt unit 23 and guides the sheet S to the fixing unit 13.

The printer 1 further includes a cleaning unit 31 disposed beneath the belt unit 23 within the main casing 2. The cleaning unit 31 includes a collecting box 32 and a pair of cleaning rollers 33A and 33B. The cleaning roller 33A is disposed at a position higher than the cleaning roller 33B, and an upper section of an outer peripheral surface of the cleaning roller 33A is in contact with a lower part of the outer peripheral surface of the conveying belt 11 in the entire width. The pair of cleaning rollers 33A and 33B are applied with a bias voltage. The toner clinging on the outer peripheral surface of the conveying belt 11 without being transferred onto the sheet S is captured by the cleaning roller 33A, and then collected into the collecting box 32. In this manner, the cleaning unit 31 cleans the belt unit 23.

Figure 3:
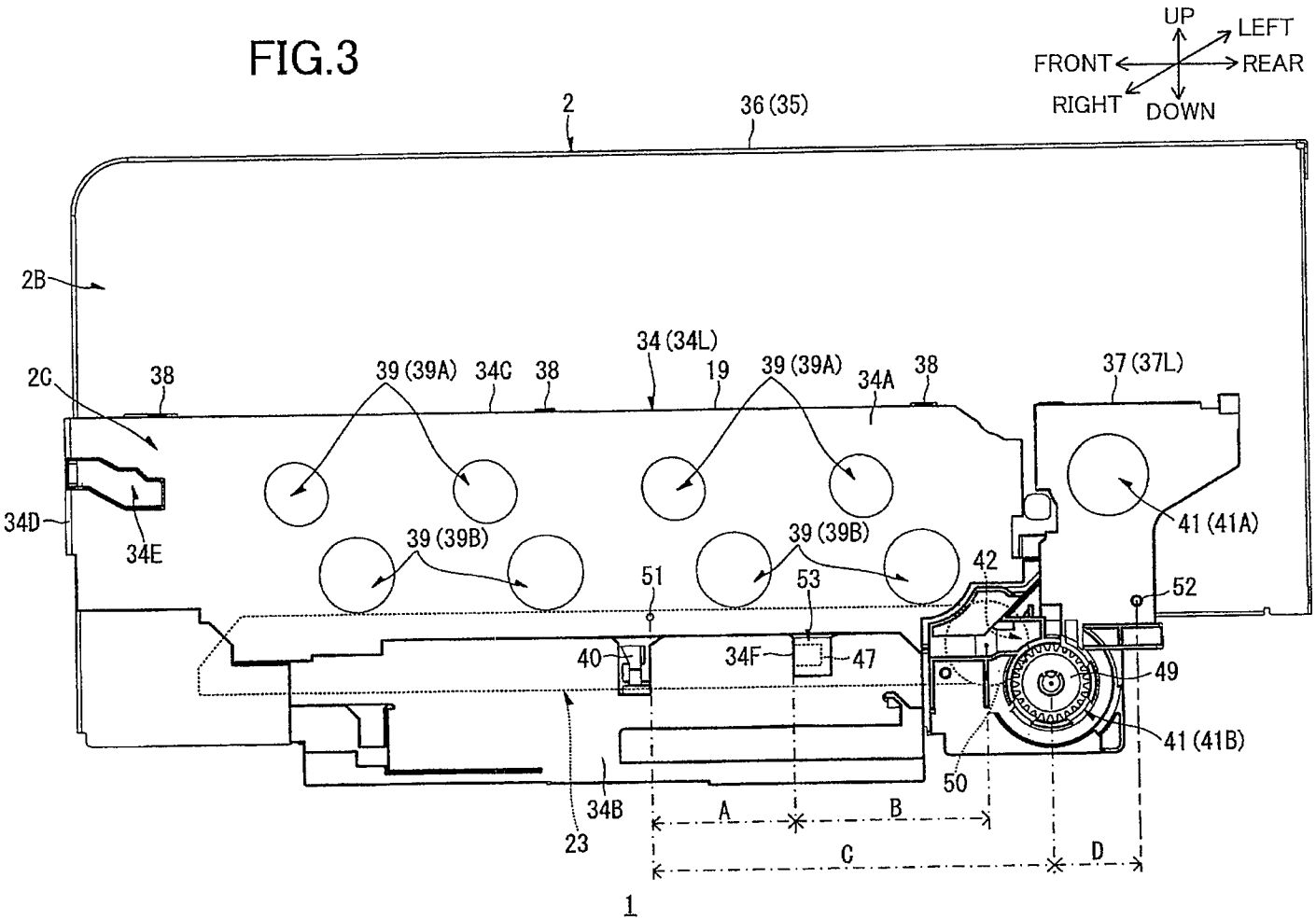
FIG. 3 is a right-side view of a left side wall attached with a first left frame and a second left frame of the printer.

Next, the main casing 2 will be described further. As shown in FIG. 2, the main casing 2 includes a main frame 35 made of metal. The main frame 35 has a pair of right and left side walls 36 disposed with a space therebetween in the width direction. The right side wall 36 is indicated by a dotted chain line in FIG. 2. As shown in FIG. 3, the side walls 36 have a rectangular plate shape with a thin width dimension and a surface aligned with the front-to-rear and vertical directions. The side walls 36 are formed by pressing metal plates with a prescribed die.

The process unit 17, the belt unit 23, the fixing unit 13, and the guide member 30 shown in FIG. 1 are all disposed between the side walls 36. Hence, the left and right side walls 36 define an interior space 2C (FIG. 2) of the main casing 2 in the width direction. As shown in FIG. 2, the belt unit 23 is disposed to extend in the front-to-rear direction at a position between lower sections of the side walls 36.

The opening 2B is in fluid communication with the interior space 2C from the front side. Also, the front endfaces of the side walls 36 are located near the opening 2B.

First frames 34 and second frames 37 are disposed on widthwise inner side surfaces of the side walls 36 (a right side surface of the left side wall 36, a left side surface of the right side wall 36). The second frames 37 are depicted with shading in FIG. 2. The first frames 34 and the second frames 37 are formed with a resin (e.g., ABS resin) with a higher linear expansion coefficient than the main frame 35 made of metal.

The first frames 34 will be described in detail. The first frames 34 are disposed one on either right or left side in the main casing 2 with a space therebetween in the width direction. Each of the first frames 34 is in a plate shape long in the front-to-rear direction and thin in the width direction. More specifically, the length of the first frame 34 in the front-to-rear direction is about three fourths of the length of the side wall 36, and the height of the first frame 34 in the vertical direction is about a half of that of the side wall 36.

As shown in FIG. 3, each first frame 34 has an upper section 34A, which is approximately an upper half section, and a lower section 34B, which is approximately a lower half section. The upper section 34A is slightly longer in the front-to-rear direction than the lower section 34B. A widthwise inner side surface of the lower section 34B is located farther inward than that of the upper section 34A.

The left first frame 34 (hereinafter referred to also as "left first frame 34L") is attached to the right side surface of the left side wall 36, and the right first frame 34 is attached to the left side surface of the right side wall 36. Each first frame 34 is attached to the corresponding side wall 36 at a position slightly lower than the center of the side wall 36 in the vertical direction. As shown in FIG. 2, a front endface 34D of the first frame 34 is flush with the front endface of the corresponding side wall 36. The process unit 17 (FIG. 1) described above is disposed in the interior space 2C between the first frames 34.

Almost the entire of the peripheral edges of each first frame 34 (i.e., upper, lower, front, and rear edges) are bent outward in the width direction (i.e., bent leftward in the case of the left first frame 34L). The upper edge of each first frame 34 that has bent in this manner forms an upper endface 34C that functions as a guide rail 19 extending in an attachment/detachment direction of the process unit 17 (in the front-to-rear direction in this embodiment) for guiding the process unit 17 during detachment and attachment thereof.

The guide rail 19 is integrally formed with a plurality of craws 38 arrayed at predetermined intervals in the front-to-rear direction on a widthwise outer edge thereof. The first frame 34 is positioned with respect to the corresponding side wall 36 with the craws 38 engaging therewith. However, the first frame 34 is fixed to the side wall 36 mainly with a first positioning member 51 shown in FIG. 3 differing from the craws 38. Details of the first positioning member 51 will be described later.

The front edge of each first frame 34 that has bent outward as described above forms the front endface 34D and covers a cutout part 36A formed in the front endface of the side wall 36 from the front side. When the cover 18 (FIG. 1) is closed, the cutout part 36A confronts the cover 18 from the rear side with the front endface 34D interposed therebetween.

In other words, when the cover 18 is open, the cutout part 36A is exposed from the opening 2B if not covered with the front endface 34D. However, because the front endface 34D covers the cutout part 36A, the cutout part 36A is not exposed even when the cover 18 is open. Thus, when the user opens the cover 18, the user cannot see edges of the cutout part 36A of the bear metal main frame 35, making the interior space 2C look better.

Each first frame 34 is formed at its front section with a cutout part 34E in a region not overlapping with the cutout part 36A in the front-to-rear direction. As shown in FIG. 1, the process unit 17 is formed at its front section with a positioning shaft 17A that projects outward in the width direction, and each cutout part 34E receives the positioning shaft 17A, allowing the process unit 17 to engage with the front sections of the side walls 36. In this manner, the front section of the process unit 17 is positioned with respect to the main casing 2.

The cleaning unit 31 (FIG. 1) is attached to a front section of the lower part 34B (FIG. 2) of at least one of the first frames 34. In this manner, the cleaning unit 31 is supported to at least one of the first frames 34.

As shown in FIG. 3, a ground electrode 40 is disposed on each first frame 34. For example, the ground electrode 40 is disposed approximately in the center of the lower section 34B of the first frame 34 in the front-to-rear direction. The ground electrode 40 connects the belt unit 23 to the ground.

The upper section 34A of the left first frame 34L is formed with a pair of upper and lower rows of through holes 39 (39A, 39B), both extending in the front-to-rear direction. The upper row includes four through holes 39A, and the lower row includes four through holes 39B smaller than the through holes 39A. During image forming operations, driving force is transmitted to the developing rollers 5 (FIG. 1) through the through holes 39A and to the photosensitive drums 3 (FIG. 1) through the through holes 39B.

Next, the second frames 37 will be described in detail. As shown in FIG. 2, the pair of second frames 37 (37L, 37R) are disposed within the main casing 2 with a space therebetween in the width direction. The left second frame 37L is attached to a rear section of the right side surface of the left side wall 36, and the right second frame 37R is attached to a rear section of the left side surface of the right side wall 36. More specifically, the second frames 37 are disposed on the rear side of the first frames 34.

The second frames 37 confront each other in the width direction. That is, the second frames 37 are located at substantially the same position with respect to the vertical direction and the front-to-rear direction. A method to attach the second frames 37 to the side walls 36 will be described later.

Each of the second frames 37 is in a block shape long in the vertical direction and thin in the width direction. However, the second frames 37 have different shapes.

Figure 4:
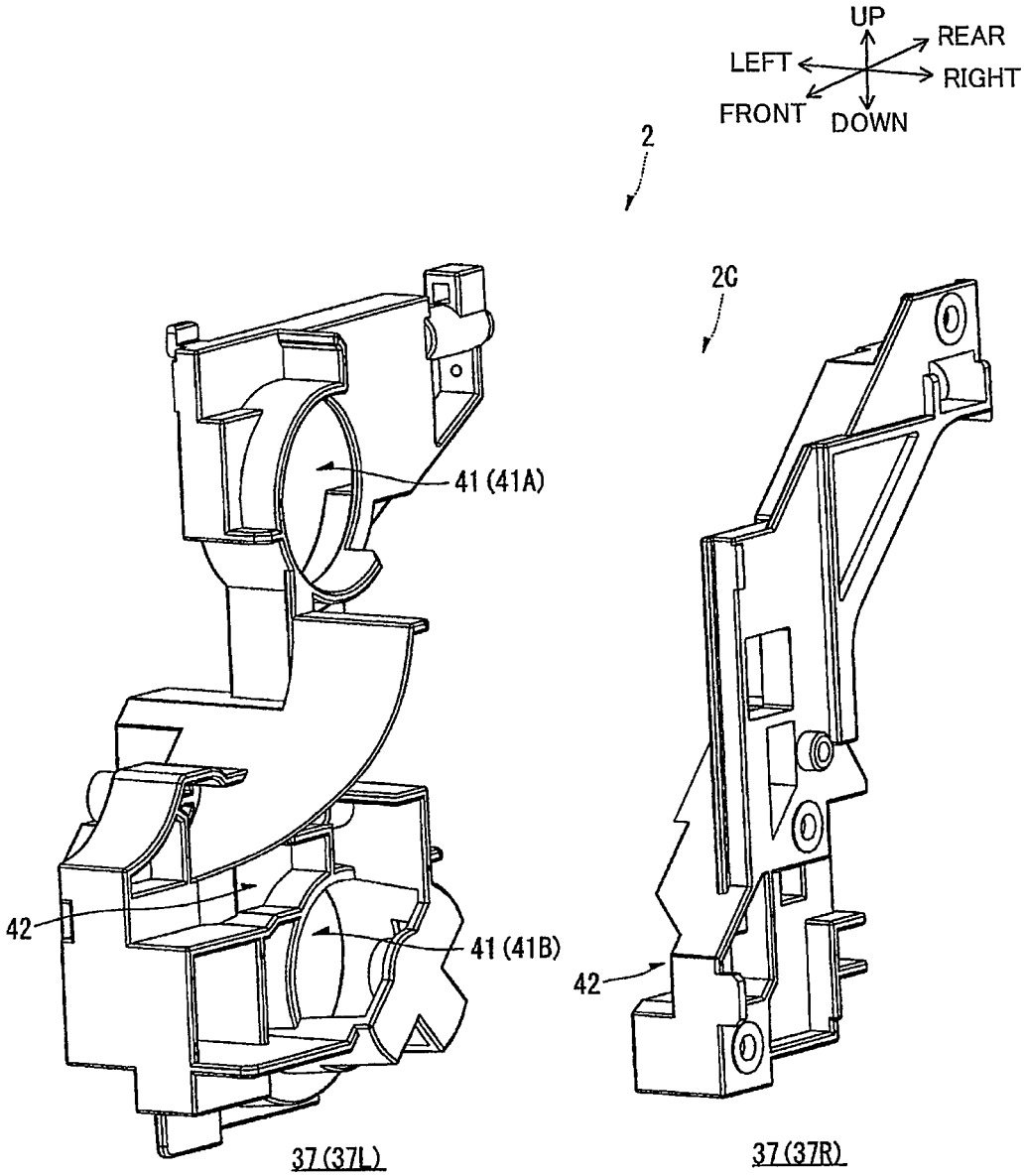
FIG. 4 is a perspective view of a pair of first frames of the printer from a point diagonally right and frontward thereof.

Specifically, the left second frame 37L when viewed from the right side is shaped substantially like the letter J. The front-to-rear dimension of the left second frame 37L expands toward the rear from the approximate vertical center of the left second frame 37L upward, and expands toward the front from the approximate vertical center downward. As shown in FIG. 4, two openings 41 (41A, 41B) penetrating the left second frame 37L in the width direction are formed in the left second frame 37L at positions aligned vertically.

A gear or other inputting means (not shown) linked to an output member (motor or the like; not shown) on the main casing 2 side for inputting a drive force into the fixing unit 13 (FIG. 1) is inserted into the top opening 41A along the width direction from the outer side thereof. As shown in FIG. 3, an output gear 49 connected to an output member (motor or the like; not shown) on the main casing 2 side for inputting a drive force into the belt unit 23 is inserted into the bottom opening 41B along the width direction from the outer side thereof.

That is, the output gear 49 is supported to the left second frame 37L. The output gear 49 is a cylindrical member formed with gear teeth formed on its outer peripheral surface with a center axis extending in the width direction. In a condition where the output gear 49 is inserted through the through hole 41B, a front section of the outer peripheral surface of the output gear 49 is exposed to the right side and front side of the left second frame 37L.

As shown in FIG. 2, the right second frame 37R, on the other hand, extends upward from the bottom edge thereof in substantially a vertical direction, and then extends upward along a slope to the rear.

As shown in FIG. 4, a recessed part 42 is formed in the widthwise inner surface of each second frame 37 (the right surface of the left second frame 37L and the left surface of the right second frame 37R) at substantially opposing positions in the lower ends thereof. The recessed parts 42 are groove-like cutout portions extending in the front-to-rear direction that are formed in the inner widthwise surfaces of the corresponding second frames 37 from the front edge to a midpoint in the front-to-rear direction. Hence, the front end of each recessed part 42 is open in the front endface of the corresponding second frame 37 and exposed on the front side thereof.

Figure 5:
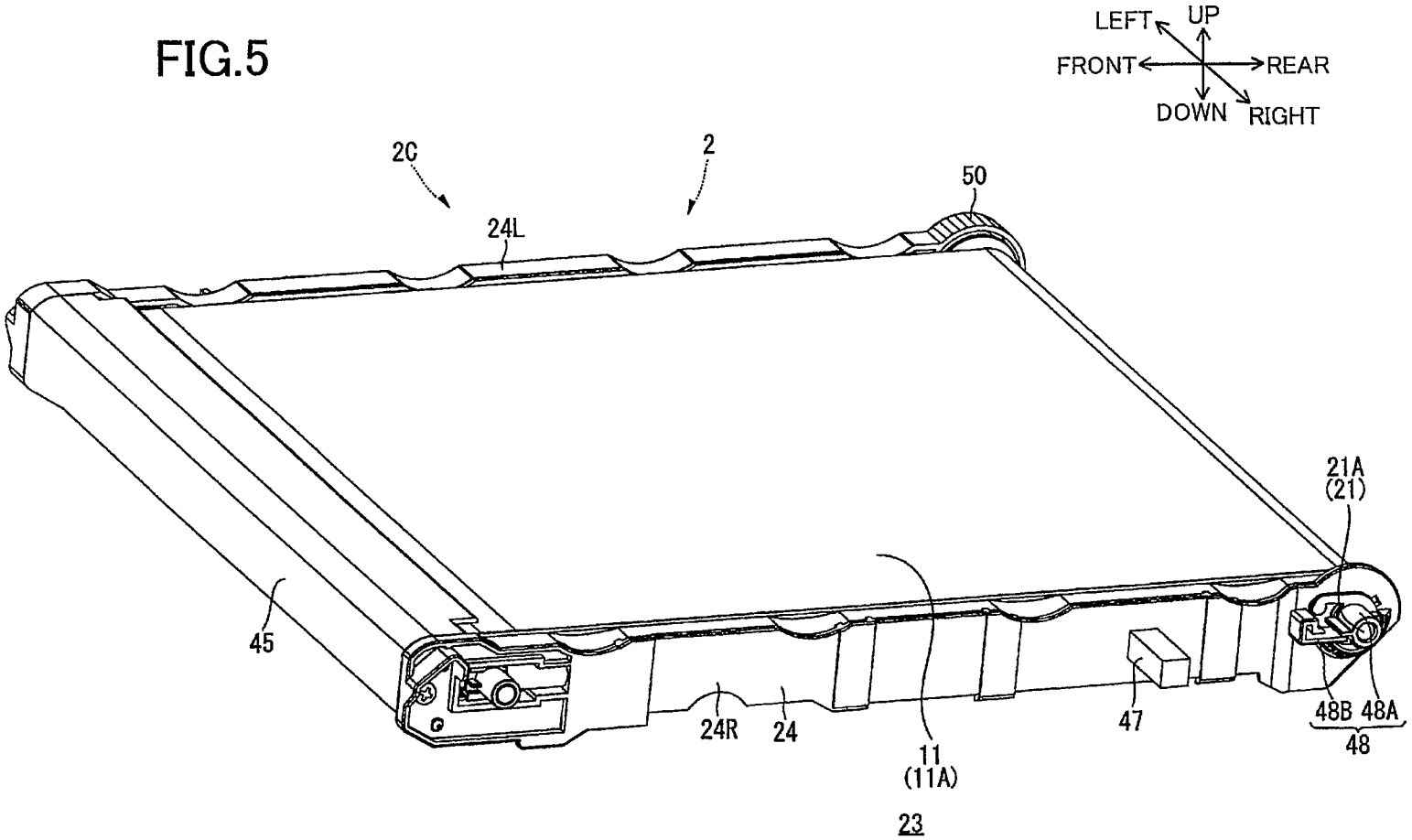
FIG. 5 is a perspective view of a belt unit of the printer from a point diagonally rightward and frontward thereof.

Next, the belt unit 23 will be described in detail. As shown in FIG. 5, the belt frame 24 is in a substantial plate shape elongated in the front-to-rear direction and thin in the vertical direction. The belt frame 24 is formed with a resin with a linear expansion coefficient that is higher than that of the main frame 35 but lower than that of the first frames 34 and the second frames 37 (FIG. 2). An example of such resin is Maltiron (Registered Trademark) added with a predetermined amount of filler. Here, because the belt unit 23 consists largely of the belt frame 24, it could be said that the belt unit 23 is made of Maltiron (Registered Trademark).

Most of the belt frame 24 is disposed inside the conveying belt 11. However, on the left and right sides, the belt frame 24 has left and right side frame parts 24L and 24R spanning the entire length of the belt frame 24 in the front-to-rear direction and protruding outward beyond the conveying belt 11 in the width direction.

A grip part 45 spans between the front ends of the side frame parts 24L and 24R. The grip part 45 is elongated in the width direction and is positioned in front of the conveying belt 11 to oppose the front end of the conveying belt 11, but is separated therefrom. An operator grips the grip part 45 when mounting the belt unit 23 in the main casing 2 or removing the belt unit 23 therefrom, as described above.

A front boss 47 and a rear boss 48 protrude outward in the width direction from each of the side frame parts 24L and 24R. The front bosses 47 are disposed to the rear of the center of the belt frame 24 in the front-to-rear direction, and the rear bosses 48 are disposed in the rear sections. Each of the front bosses 47 is in a square prism shape extended in the width direction. Each of the rear bosses 48 is integrally provided with a cylindrical body 48A, and a rib 48B connected to the front side of the cylindrical body 48A and slightly elongated in the front-to-rear direction. Overall, the rear boss 48 is elongated in the front-to-rear direction.

Lateral ends of a shaft 21A of the drive roller 21 are inserted to the cylindrical members 48A of the rear bosses 48. That is, the drive roller 21 is rotatably supported to the cylindrical members 48A of the rear bosses 48.

The input gear 50 is attached to a left section of the shaft 21A. More specifically, the input gear 50 is a cylindrical member formed with gear teeth on its outer peripheral surface with a center axis extending in the width direction. The left section of the shaft 21A is inserted to the center of the input gear 50 so that the input gear 50 is rotatable integrally with the shaft 21A (drive roller 21).

The first frames 34 and the second frames 37 are attached to the main frame 35 in the following manner.

As shown in FIG. 3, each of the first frames 34 is integrally formed with the first positioning member 51 mentioned above in a lower part of the upper section 34A at a position slightly rearward of the center thereof in the front-to-rear direction. The first positioning member 51 may be either a protrusion protruding outward in the width direction or a hole.

If the first positioning member 51 is the protrusion, then the side wall 36 is formed with a hole at a position corresponding to the first positioning member 51, and the first positioning member 51 is inserted to the hole. However, if the first positioning member 51 is the hole, then the side wall 36 is formed with a protrusion at a position corresponding to the first positioning member 51, and the protrusion is inserted to the first positioning member 51.

In this manner, the first positioning member 51 is supported to the corresponding side wall 36 (i.e., the main frame 35). In other words, the first positioning member 51 positions the first frame 34 with respect to the main frame 35.

Similarly, each of the second frame 37 is integrally formed with a second positioning member 52 in a rear section (the second positioning member 52 of the left second frame 37L is located at a position diagonally above and rear of the through hole 41B). The second positioning member 52 may be either a protrusion protruding outward in the width direction or a hole.

The second positioning member 52 is supported to the corresponding side wall 36 (i.e., the main frame 35), in the same manner as the first positioning member 51. That is, the second positioning member 52 positions the corresponding second frame 37 with respect to the main frame 35.

The belt unit 23 is indirectly supported to the main frame 35 in the following manner.

That is, the rear bosses 48 (FIG. 5) of the belt frame 24 of the belt unit 23 are received in the grooves 42 (FIG. 4) of the second frames 37 from the front side. In this manner, the rear section of the belt unit 23 is supported to the second frames 37. The rear bosses 48 received in the grooves 42 can move in the front-to-rear direction to some extent, but cannot move in the vertical direction. That is, the belt unit 23 is positioned with respect to the second frames 37 in the vertical direction by the rear bosses 48.

On the other hand, the front bosses 47 (FIG. 5) of the belt frame 24 are supported to the first frames 34. More specifically, as shown in FIG. 3, each first frame 34 is formed with a recess 53 denting outward in the width direction, at a position confronting the corresponding front boss 47, and the front boss 47 is received in the corresponding recess 53. In this condition, the front boss 47 is urged frontward by an urging member (not shown) so as to be pressed against a partitioning surface 34F that is a front surface of the recess 53, so the front boss 47 is unmovable in the front-to-rear direction. That is, the belt unit 23 is positioned with respect to the first frames 34 in the front-to-rear direction by the front bosses 47.

In this manner, the belt unit 23 is directly supported to the first frames 34 and the second frames 37, and is indirectly supported to the main frame 35 via the first frames 34 and the second frames 37.

Because the belt unit 23 is directly supported to the first frames 34 and the second frames 37, but not to the main frame 35, a user hardly see the bear metal main frame 35 when looks into the interior space 2C of the main casing 2, making the interior space 2C look better.

In a condition where the first frames 34, the second frames 37, and the belt unit 23 are all supported to the main frame 35, the input gear 50 (FIG. 5) attached to the belt unit 23 is, as shown in FIG. 3, in meshing engagement with the output gear 49 supported to the left second frame 37L from the front side. That is, the output gear 49 is linked to the input gear 50.

As a result, the driving force from the output member (not shown) on the main casing 2 is transmitted through the output gear 49 and the input gear 50 to the drive roller 21 of the belt unit 23, thereby rotating the conveying belt 11.

Also, the front boss 47 of the belt unit 23 and the recess 53 for receiving the front boss 47 are disposed between the first positioning member 51 and the input gear 50 in the front-to-rear direction.

As described above, the linear expansion coefficient of the resin used for the first frames 34 and the second frames 37 is relatively large, and that of the resin used in the belt unit 23 is relatively small. The reason for using resins having different linear expansion coefficients like this is that the resin with a larger linear expansion coefficient is less expensive than those with a lower linear expansion coefficient. In order to suppress production costs, it is preferable to use the resin with a larger linear expansion coefficient. Also, resin with a larger linear expansion coefficient is soft and easier to form products in a complex shape. However, the belt unit 23 needs some strength to accurately convey the sheet S, so resin with a large linear expansion coefficient is unsuitable for the belt unit 23 because such resin does not have a sufficient strength. Thus, it is ideal that resin with a relatively low linear expansion coefficient be used in the belt unit 23 and that resin with a relatively large linear expansion coefficient be used for the first frames 34 and the second frames 37.

The first frames 34, the second frames 37, and the belt unit 23 thermally expand based on the main frame 35 as the internal temperature of the printer 1 increases during image forming operations. Because the belt unit 23 is mainly made of resin with a lower linear expansion coefficient than that of the first frames 34, the belt unit 23 does not expand as much as the first frames 34. Thus, if the output gear 49 is supported to the left first frame 34L, the output gear 49 is highly likely disengaged from the input gear 50 supported to the belt unit 23 because of difference between the linear coefficient coefficients of the belt unit 23 and the left first frame 34L.

More specifically, if the first frame 34 and the second frame 37 are formed integrally with each other and supported to the main frame 35 only with the first positioning member 51, and if both the output gear 49 and the belt unit 23 are supported to the first frame 34, then the positions of the input gear 50 and the output gear 49 with respect to the first positioning member 51 shift toward the rear due to thermal expansion, and amounts of positional shift can be expressed by the following equations:

$$\text{positional shift amount } X \text{ of the input gear } 50 = A\times\alpha + B\times\beta$$

$$\text{positional shift amount } Y \text{ of the output gear } 49 = C\times\alpha$$

wherein:

A is a distance between the first positioning member 51 and the front boss 47 (the contact point between the front boss 47 and the partitioning surface 34F) in the front-to-rear direction;

B is a distance between the front boss 47 (the contact point between the front boss 47 and the partitioning surface 34F) and the center of the input gear 50 in the front-to-rear direction;

C is a distance between the first positioning member 51 and the center of the output gear 49;

$\alpha$ is a linear expansion coefficient of the resin of the first frames 34 and the second frames 37; and $\beta$ is a linear expansion coefficient of the resin of the belt unit 23.

Because the linear expansion coefficient $\alpha$ is greater than the linear expansion coefficient $\beta$, and because the distance C is greater than the sum of the distance A and the distance B as shown in FIG. 3, the positional shift amount Y of the output gear 49 is greater than the positional shift amount X of the input gear 50. Thus, there is a danger that the output gear 49 is disengaged from the input gear 50 toward the rear due to thermal expansion in association with increase in internal temperature of the printer 1, unstabilizing transmission of driving force between the output gear 49 and the input gear 50.

However, according to the present embodiment, the output gear 49 is supported to the second frame 37 differing from the first frame 34, the output gear 49 does not shift the above-described amount Y. More precisely, due to the thermal expansion of the metal main frame 35, the output gear 49 shifts rearward by an amount obtained from the multiplication (linear expansion coefficient $\gamma$ of the metal main frame 35)×(the distance C+a distance D between the center of the output gear 49 and the second positioning member 52). However, this amount is small enough to be ignored.

Because the output gear 49 hardly shifts as described above, it is possible to prevent the output gear 49 from disengaging from the input gear 50 even if the belt unit 23 and the first frames 34 thermally expand, so engagement between the input gear 50 and the output gear 49 can be maintained.

Thus, it is possible to reliably transmit the driving force to the belt unit 23 even if the linear expansion coefficient of the belt unit 23 greatly differs from that of the first frames 34 supporting the belt unit 23. Here, the linear expansion coefficient $\alpha$ of the first frames 34 and the second frames 37 is $8.0\times10^{-5}$ (mm/° C.), and the linear expansion coefficient $\beta$ of the belt unit 23 is $3.5\times10^{-5}$ (mm/° C.), and linear expansion coefficient $\gamma$ of the main frame 35 is $1.2\times10^{-5}$ (mm/° C.), for example.

In order to maintain the meshing engagement between the input gear 50 and the output gear 49, it is preferable that the first positioning member 51 be positioned nearer to the input gear 50 than the center of the first frame 34 in the front-to-rear direction, and that the front boss 47 be positioned nearer to the input gear 50 than the center of the belt unit 23 in the front-to-rear direction. It is also preferable that the first positioning member 51 be positioned near the front boss 47. By doing so, the positional shift amount X of the input gear 50 can be suppressed.

However, positioning the first positioning member 51 at a position greatly separated from the center of the first frame 34 in the front-to-rear direction makes the linear expansion amount of the first frame 34 uneven in the front-to-rear direction. Thus, it is preferable that the first positioning member 51 be located at a position not greatly separated from the center of the first frame 34 in the front-to-rear direction. The same is also true for the front boss 47.

As described above, according to the present embodiment, the front boss 47 of the belt unit 23 that is supported to the first frame 34 is located between the first positioning member 51 of the first frame 34 supported to the main frame 35 and the input gear 50. Thus, when the first frame 34 and the belt unit 23 thermally expand, the input gear 50 is shifted rearward, i.e., toward the output gear 49, by an amount equivalent to the positional shift amount X described above. On the other hand, the output gear 49 that is positioned on the front side of the second positioning member 52 shifts frontward, i.e., toward the input gear 50, by an amount obtained by the multiplication (the distance D between the second positioning member 52 and the center of the output gear 49)×(the linear expansion coefficient $\alpha$ of the second frame 37). Thus, it is possible to reliably maintain the engagement between the output gear 49 and the input gear 50.

Here, although the thermal expansion of the main frame 35 shifts the output gear 49 rearward as described above, the thermal expansion of the second frame 37 shifts the output gear 49 frontward more, so the output gear 49 is shifted rearward in the event.

It may be concerned that the output gear 49 and the input gear 50 excessively come close to each other by the input gear 50 shifting rearward and the output gear 49 shifting frontward, preventing smooth rotation of the input gear 50 and the output gear 49. In this case, the front boss 47 may be positioned on the front side of the first positioning member 51 instead of between the first positioning member 51 and the input gear 50. With this configuration, the input gear 50 shifts frontward, so it is possible to prevent the input gear 50 from excessively coming close to the output gear 49.

As described above, the cleaning unit 31 (FIG. 1) for cleaning the belt unit 23 is attached to the first frame 34. Thus, the first frame 34 has a relatively large size, and thus has a relatively large thermal expansion amount. Also, the guide rails 19 for guiding the attachment and detachment of the process unit 17 extend in the front-to-rear direction (attachment/detachment direction of the process unit 17) as described above. Thus, the first frames 34 formed with the guide rails 19 have a relatively long length in the front-to-rear direction and have a relatively large thermal expansion amount for this reason also.

Further, the ground electrodes 40 are attached to the first frames 34 as described above. Attaching the ground electrodes 40 to the first frames 34 while preventing leakage from the ground electrodes 40 to surrounding components enlarges the first frames 34 to some extent. This also increase the thermal expansion amount of the first frames 34. Moreover, because the first frames 34 are extended to positions near the opening 2B as described above, the first frames 34 are relatively long in the front-to-rear direction and thus have a relatively large thermal expansion amount for this reason also.

However, according to the present embodiment, the output gear 49 is attached to the second frame 37, but not to the first frame 34, so the linkage between the input gear 50 and the output gear 49 can be maintained even though the first frame 34 has the relatively large thermal expansion amount. This reliably transmits the driving force to the belt unit 23.

Also, because the belt, unit 23 and the cleaning unit 31 are both attached to the first frames 34, the relative position between the belt unit 23 and the cleaning unit 31 can be improved.

While the invention has been described in detail with reference to the embodiment thereof, it would be apparent to those skilled in the art that various changes and modifications may be made therein without departing from the spirit of the invention.

What is claimed is:

1. An image forming device comprising:

a main body including a pair of main frames made of metal;

a plurality of photosensitive members arrayed in a predetermined direction in the main body and disposed between the pair of main frames;

a first frame attached to each of the pair of main frames and made of a first resin with a higher linear expansion coefficient than the metal of the pair of main frames;

a second frame attached to each of the pair of main frames and made of a second resin with a higher linear expansion coefficient than the metal of the pair of main frames;

a conveying section supported by each of the first frames so as to confront the plurality of photosensitive members, the conveying section being made of a third resin with a linear expansion coefficient that is higher than that of the metal of the pair of main frames and lower than that of the resin of the first frames and the second frames;

an input section provided to the conveying section for transmitting a driving force to the conveying section, wherein the conveying section conveys a recording medium upon receiving the driving force through the input section; and an output section supported by at least one second frame and linked to the input section, the output section being configured to transmit the driving force to the input section.

2. The image forming device according to claim 1, wherein each of the first frames is supported by one of the main frames at a first section, and the conveying section is supported by each of the first frames at a second section between the first section and the input section in the predetermined direction.

3. The image forming device according to claim 2, wherein the first section is nearer to the input section than a center of each of the first frames in the predetermined direction, and the second section is nearer to the input section than a center of the conveying section in the predetermined direction.

4. The image forming device according to claim 1, further comprising a cleaning unit supported by each of the first frames, the cleaning unit cleaning the conveying section.

5. The image forming device according to claim 1, further comprising a support unit mounted on the main body so as to be detachable from the main body in an attachment/detachment direction, the support unit including the plurality of photosensitive members, wherein each of the first frames is formed with a rail extending in the attachment/detachment direction, the rail guiding attachment and detachment of the support unit to and from the main body.

6. The image forming device according to claim 5, further comprising an electrode disposed on at least one first frame.

7. The image forming device according to claim 5, wherein the main body is formed with an opening through which the support unit is selectively detached from and attached to the main body and has a cover that selectively opens and closes the opening, and each of the first frames covers a part of a corresponding main frame that confronts the cover in a closed state.

8. The image forming device according to claim 1, wherein:

the conveying section includes a first roller, a second roller, a belt frame rotatably supporting the first roller and the second roller, and a belt wrapped on the first roller and the second roller, the belt frame being made of the third resin; and the input section is attached to the first roller.

9. The image forming device according to claim 1, wherein each of the first frames is aligned with a corresponding one of the second frames in the predetermined direction.

10. The image forming device according to claim 1, wherein the input section and the output section are configured to be in direct contact with each other.

11. The image forming device according to claim 1, wherein each of the second frames is supported by one of the main frames at a third section, the output section being positioned between the third section and the input section in the predetermined direction.

12. An image forming device comprising:

a main body including a pair of main frames made of metal;

a plurality of photosensitive members arrayed in the main body and disposed between the pair of main frames;

a first frame attached to each of the pair of main frames and made of a first resin with a higher linear expansion coefficient than the metal of the pair of main frames;

a second frame attached to each of the pair of main frames and made of a second resin with a higher linear expansion coefficient than the metal of the pair of main frames;

a conveying section supported by each of the first frames and confronting the plurality of photosensitive members and configured to convey a recording medium, the conveying section being made of a third resin with a linear expansion coefficient that is higher than that of the metal of the pair of main frames and lower than that of the resin of the first frames and the second frames;

an input section provided at the conveying section and configured to receive a driving force to cause the conveying section to convey the recording medium; and an output section supported by at least one second frame and linked to the input section, the output section being configured to transmit the driving force to the input section.

13. An image forming device comprising:

a main body comprising two main frames made of metal;

a plurality of photosensitive members arrayed in the main body and disposed between the two main frames;

two first frames, wherein each of the first frames is attached to a corresponding one of the main frames, and wherein the first frames are made of a first resin with a higher linear expansion coefficient than the metal of the main frames;

two second frames, wherein each of the second frames is attached to a corresponding one of the main frames, and wherein the second frames are made of a second resin with a higher linear expansion coefficient than the metal of the main frames;

a conveying unit supported by the first frames, wherein the conveying unit is made of a third resin with a linear expansion coefficient that is higher than that of the metal of the main frames and lower than that of the resin of the first frames and the second frames;

an input unit for transmitting a driving force to the conveying unit, wherein the conveying unit conveys a recording medium upon receiving the driving force from the input unit; and an output unit supported by at least one second frame and linked to the input unit, the output unit being configured to transmit the driving force to the input unit.

14. The image forming device according to claim 13, wherein each of the first frames is supported by the corresponding one of the main frames at a first location, and wherein the conveying unit is supported by each of the first frames at a second location, wherein the second location is between the first location and a location of the input unit in a first direction.

15. The image forming device according to claim 14, wherein the first location is nearer to the location of the input unit than a location of a center of each of the first frames in the first direction, and the second location is nearer to the location of the input unit than a location of a center of the conveying unit in the first direction.

16. The image forming device according to claim 13, further comprising a cleaning unit supported by each of the first frames, wherein the cleaning unit is configured to clean the conveying unit.

17. The image forming device according to claim 13, further comprising a support unit mounted on the main body so as to be detachable from the main body in an attachment/detachment direction, the support unit including the plurality of photosensitive members, wherein each of the first frames is formed with a rail extending in the attachment/detachment direction configured to guide attachment and detachment of the support unit to and from the main body.

18. The image forming device according to claim 17, further comprising an electrode disposed on at least one first frame.

19. The image forming device according to claim 13, wherein the conveying unit includes a first roller, a second roller, a belt frame rotatably supporting the first roller and the second roller, and a belt wrapped on the first roller and the second roller, wherein the belt frame is made of the third resin, and wherein the input unit is attached to the first roller.

20. The image forming device according to claim 13, wherein the plurality of photosensitive members are aligned in a first direction, and wherein each of the first frames is aligned with a corresponding one of the second frames in the first direction.

* * * * *